US006929500B2

(12) United States Patent
Noro

(10) Patent No.: US 6,929,500 B2
(45) Date of Patent: Aug. 16, 2005

(54) CONNECTOR AND A METHOD FOR PRODUCING A RESIN PART ASSEMBLY SUCH AS A CONNECTOR

(75) Inventor: Yutaka Noro, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/628,164

(22) Filed: Jul. 28, 2003

(65) Prior Publication Data

US 2004/0023548 A1 Feb. 5, 2004

(30) Foreign Application Priority Data

Jul. 29, 2002 (JP) ..... 2002-220123
Jul. 29, 2002 (JP) ..... 2002-220153

(51) Int. Cl.[7] ..... H01R 13/54
(52) U.S. Cl. ..... 439/358; 439/607
(58) Field of Search ..... 439/357–358, 439/353, 350, 352, 607, 610

(56) References Cited

U.S. PATENT DOCUMENTS 5,660,558 A 8/1997 Osanai et al.
5,860,826 A * 1/1999 Chang ..... 439/358
5,934,939 A 8/1999 Thenaisie et al.
6,146,205 A * 11/2000 Lai ..... 439/610
6,149,451 A * 11/2000 Weber ..... 439/358
6,361,346 B1 3/2002 Matsuoka
6,558,183 B1 * 5/2003 Ji et al. ..... 439/358
6,607,397 B1 * 8/2003 Zhang et al. ..... 439/357
2002/0028611 A1 3/2002 Hatagishi et al.

* cited by examiner

*Primary Examiner*—Tho D. Ta
*Assistant Examiner*—Felix O. Figueroa
(74) *Attorney, Agent, or Firm*—Gerald E. Hespos; Anthony J. Casella

(57) ABSTRACT

A shielded connector (20) has a housing (30) covered by a pair of shielding plates (40, 50) and provided with metallic resilient locking pieces (46) for locking the shielded connector (20) and a mating receptacle-side connector (70) together. Left and right levers (60) are provided to deform the resilient locking pieces (46) into their unlocking postures. The levers (60) are supported for rotation by the shielding plates (40, 50). Thus, a high durability can be ensured against repeated locking operations without taking advantage of the resilient deformation of a resin upon the locking operation.

8 Claims, 12 Drawing Sheets

CONNECTOR AND A METHOD FOR PRODUCING A RESIN PART ASSEMBLY SUCH AS A CONNECTOR

BACKGROUND OF THE INVENTION

1. Field of the Invention

The invention relates to a shielded connector with a metallic resilient locking piece engageable with a mating connector. Moreover, the invention relates to a method for producing a resin part assembly, such as a connector.

2. Description of the Related Art

U.S. Pat. No. 5,660,558 and FIGS. 11 and 12 herein disclose a shielded connector. With reference to FIGS. 11 and 12, the connector has a housing 1 made of a synthetic resin. Metallic shielding plates 2, 3 are mounted from above and below to cover outer surfaces of the housing 1, and a cover 4 made of a synthetic resin is mounted to cover the outer surfaces of the shielding plates 2, 3. The upper shielding plate 2 is formed integrally with a resilient locking piece 5 that is resiliently deformable up and down. A locking projection 5A is provided at the leading end of the resilient locking piece 5 to lock the connector with the mating connector. An operable portion 6 is formed at the upper surface of the cover 4 and is resiliently deformable up and down. The operable portion 6 can be pressed to deform the locking piece 5 down and to disengage the locking projection 5A from the mating connector.

The operable portion 6 takes advantages of the resilient deformation of the resin, and may be damaged while an unlocking operation is repeated. Hence, durability of the above-described connector is low A resin part assembly (e.g. a connector) that has several resin parts typically requires the parts to be molded by individual molding machines. The respective resin parts are collected at one place and assembled successively. However, molding, transporting and assembling steps are necessary for the respective resin parts. The number of operation steps drive up production costs. Further, it is necessary to control molds for the resin parts, which leads to a further increase in the production costs.

U.S. patent application Pub. Ser. No. 2002/0028611 discloses a method that includes molding an intermediate product with integral resin parts, such as a housing and a retainer, so that assembling directions are oriented in a specified direction. The resin parts are separated successively from the intermediate product and assembled. This method reduces the number of operation steps, including molding and transporting steps. Thus, the mold can be controlled easily and plural integral resin parts can be molded by one mold. However, operation steps, such as positioning and inserting the parts, still must be performed every time the resin part is separated. The number of operation steps is still too large to realize satisfactory production cost savings.

The invention was developed in view of the above and an object is to provide a shielded connector an a production method with reduced costs.

SUMMARY OF THE INVENTION

The invention relates to a connector that is connectable with a mating connector. The connector has a housing into which at least one terminal fitting can be mounted. At least one resilient locking piece is resiliently deformable between a locking posture where the resilient locking piece is engaged with the mating connector to lock the connector and the mating connector into each other and an unlocking posture where the locked state is canceled. Another part is mountable to at least partly cover surfaces of the housing. At least one movable member is supported rotatably on the other part and is adapted to deform the resilient locking piece from the locking posture to the unlocking posture. Accordingly, the movable member acts as an unlocking member for deforming the resilient locking piece into the unlocking posture.

The resilient locking piece preferably is a metallic resilient locking piece and the unlocking member preferably is formed of a synthetic resin. Thus, it is unnecessary to take advantage of the resilient deformation of the resin during an unlocking operation, and a higher durability can be ensured despite repeated unlocking operations.

The connector preferably is a shielded connector and the other part preferably is a shielding shell. Accordingly, the unlocking member for deforming the resilient locking piece into the unlocking posture is provided by and supported rotatably on the shielding shell.

The movable member preferably deforms the resilient locking piece by a leverage action using a rotatable shaft thereof as a fulcrum when being rotated. Operational efficiency is good due to the leverage action achieved by using the rotatable shaft of the movable member as a fulcrum.

The housing preferably comprises at least one stopper for preventing the resilient locking piece from being deformed excessively beyond the unlocking posture by contacting the movable member when the movable member is operated to deform the resilient locking piece into the unlocking posture.

The housing preferably comprises at least one projection having a cut-out portion into which the resilient locking piece can escape when being positioned in the unlocking posture.

The movable member preferably comprises at least one escaping portion into which the resilient locking piece escapes when being moved between the locking posture and the unlocking posture.

The invention also relates to a method for producing a resin part assembly. The assembly comprises a plurality of resin parts and at least one other part, such as a shielding shell. The method comprises molding an intermediate molded product in which the respective resin parts are coupled to each other via one or more coupling portions substantially in a positional relationship attained after the assembling is completed. The method then comprises assembling the intermediate molded product with the other part and removing the coupling portions, preferably by cutting. The removing step may be formed simultaneously with or shortly after the assembling step. Thus, the number of operation steps can be reduced to reduce production costs.

The method may be used for producing a connector. The resin part assembly may comprise a housing and at least one movable member that is movable relative to the housing. The other part may be made of a metal and may be a shielding shell. The method comprises molding the intermediate molded product so that the housing and the movable member are coupled via coupling portions and are disposed in a positional relationship corresponding to the positional relationship attained after the assembling is completed.

The method may further comprise removing the coupling portions, preferably by cutting simultaneously with or after assembling the housing and the movable member with the shield. Accordingly, the housing and the movable member are molded substantially in the positional relationship attained after the assembling is completed and are assembled with the shield at once. Thus, the number of operation steps is reduced to reduce production costs.

The molding preferably is carried out so that the coupling portions are exposed at the outer periphery of the connector when the assembling is completed. Accordingly, the coupling portions can be removed easily when the assembling is completed.

The molding step preferably is carried out with one molding dye.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
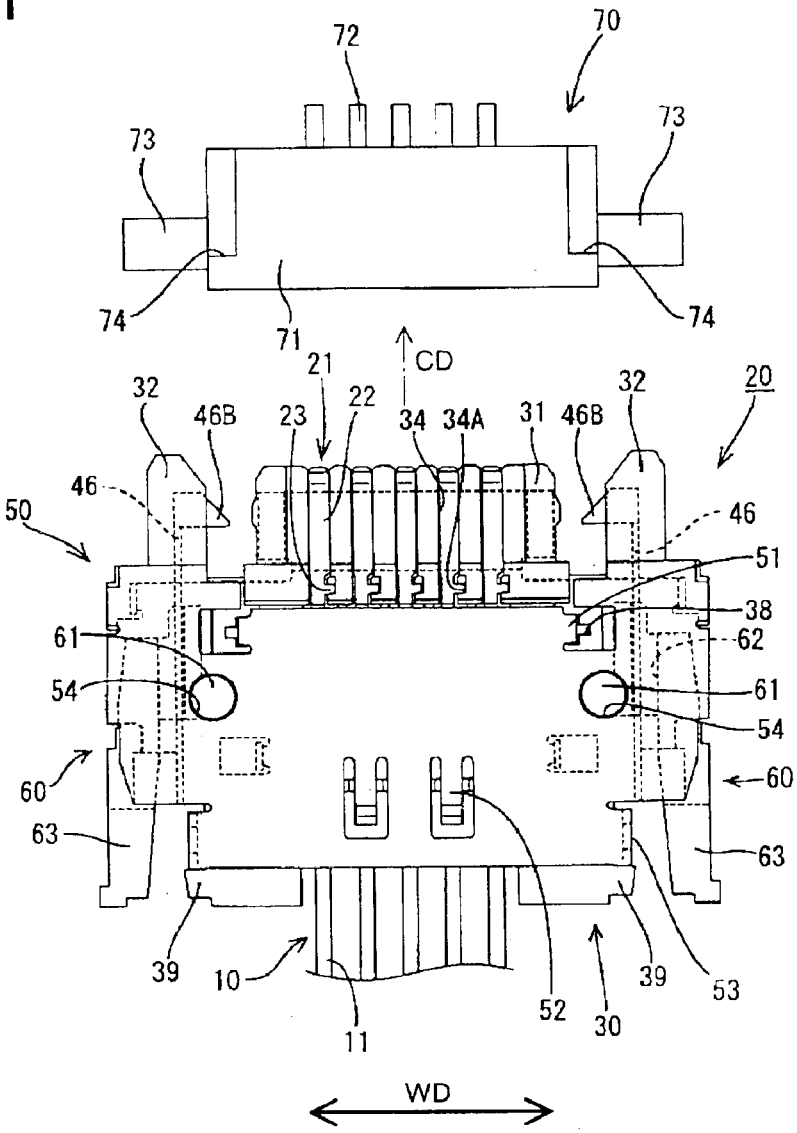
FIG. 1 is a plan view showing a state before a plug and a receptacle according to one preferred embodiment of the invention are connected.

A shielded connector according to a preferred embodiment of the invention includes a plug identified generally by the numeral 20 in FIGS. 1 to 10. The plug 20 is connectable with an end of a cable 10, as shown in FIG. 1. Additionally, the plug 20 is connectable along a connecting direction CD with a receptacle 70 that preferably is mounted on a circuit board (not shown). In the following description, connecting sides of the plug 20 and the receptacle 70 are referred to as the front sides.

Figure 3:
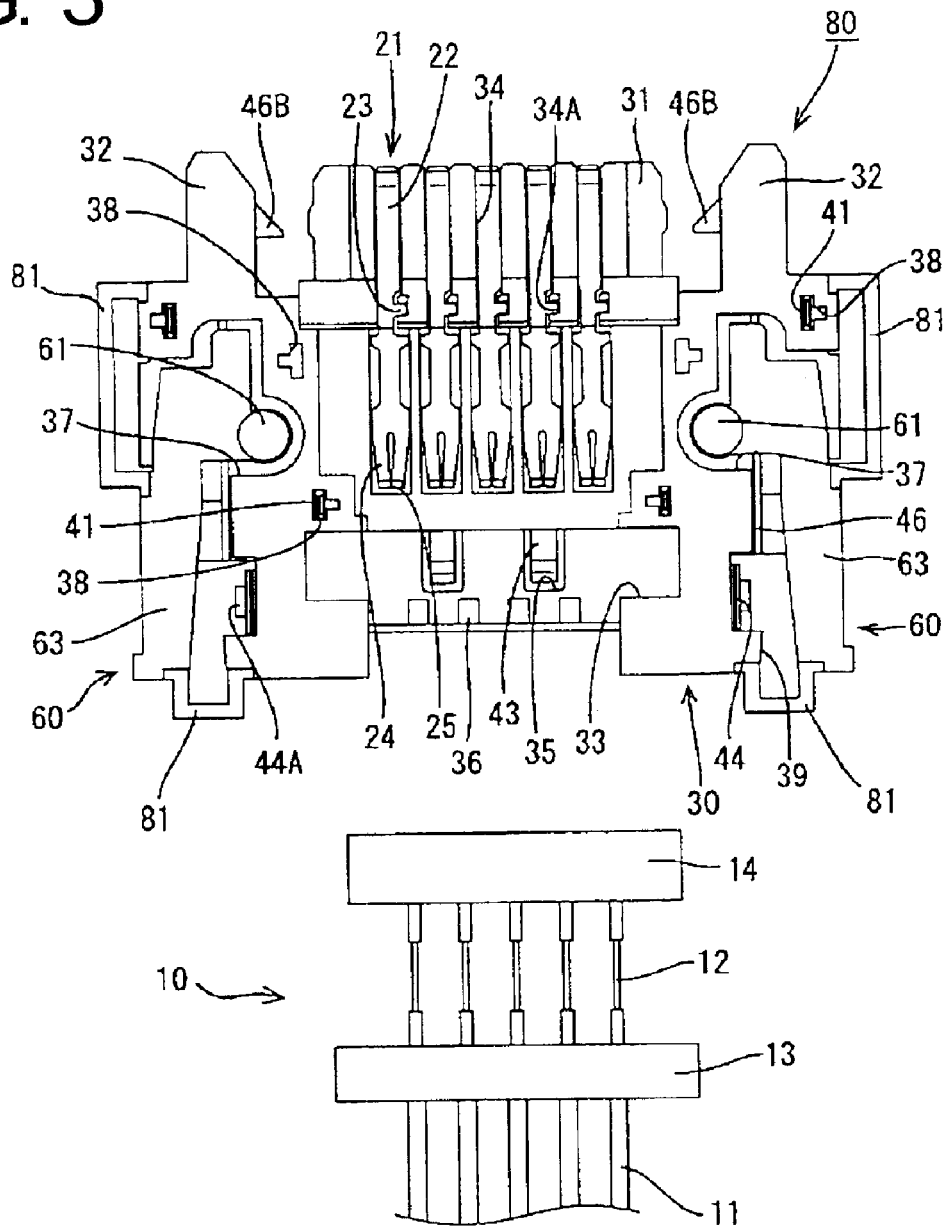
FIG. 3 is a plan view showing a state before a cable is mounted into a housing.

The cable 10 has a plurality of shielded wires 11, and cores 12 of the shielded wires 11 are exposed at the end of the cable 10, as shown in FIG. 3. Shielding layers of the shielded wires 11 are fixed and shorted by a shorting plate 13 at a portion more distant from the end of the cable 10 than the exposed cores 12. Thus, ends of the shielded wires 11 are held substantially side-by-side at a substantially even interval. Leading ends of the cores 12 are held at substantially the same interval as the ends of the shielded wires 11 by an alignment sheet 14.

Figure 2:
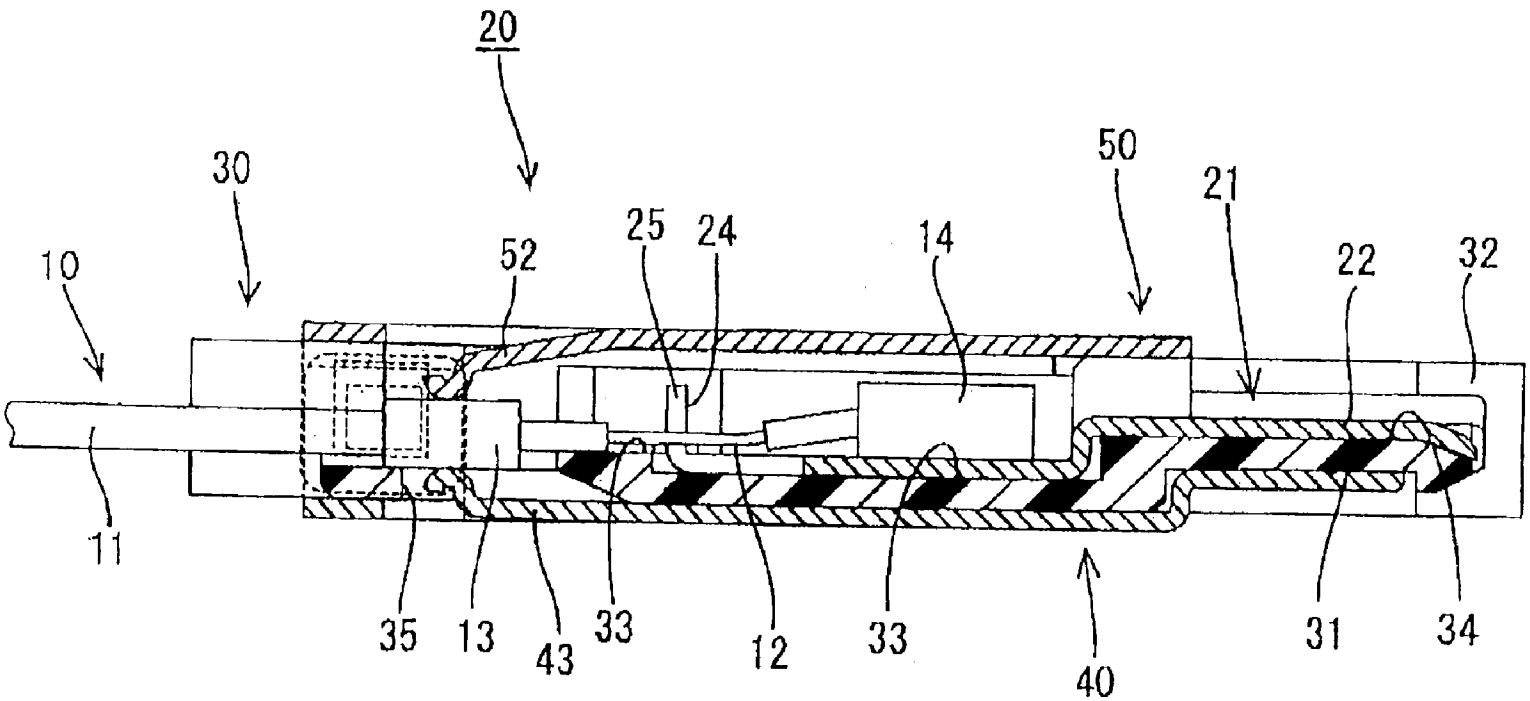
FIG. 2 is a longitudinal section of the plug.

The plug 20, as shown in FIGS. 2 and 3, has a plurality of cable-side terminal fittings 21, a cable-side housing 30 in which the terminal fittings 21 are mounted, upper and lower shielding plates 40, 50, and left and right levers 60.

Each cable-side terminal fitting 21 is narrow and long in forward and backward directions and is formed by pressing, cutting, bending, embossing and/or folding a conductive metal plate. A front side of the cable-side terminal fitting 21 is bent and slightly elevated to form a terminal connecting portion 22, and a press-in portion 23 is formed behind the terminal-connecting portion 22 by bending down a leading end extending sideways at substantially a right angle. Two arms 24 extend longitudinally at the rear end of the cable-side terminal fitting 21, and extending ends of the arms 24 are bent up at substantially right angles to form an insulation-displacement groove 25. More specifically, the two arms 24 are parallel to each other at a specified spacing when the terminal fitting 21 is stamped from the conductive metal plate, and the extending ends are bent at substantially right angles to come closer to each other toward their extending ends. Thus, the width of the insulation-displacement groove 25 is made smaller than the diameter of the core 12 of the shielded wire 11.

Figure 4:
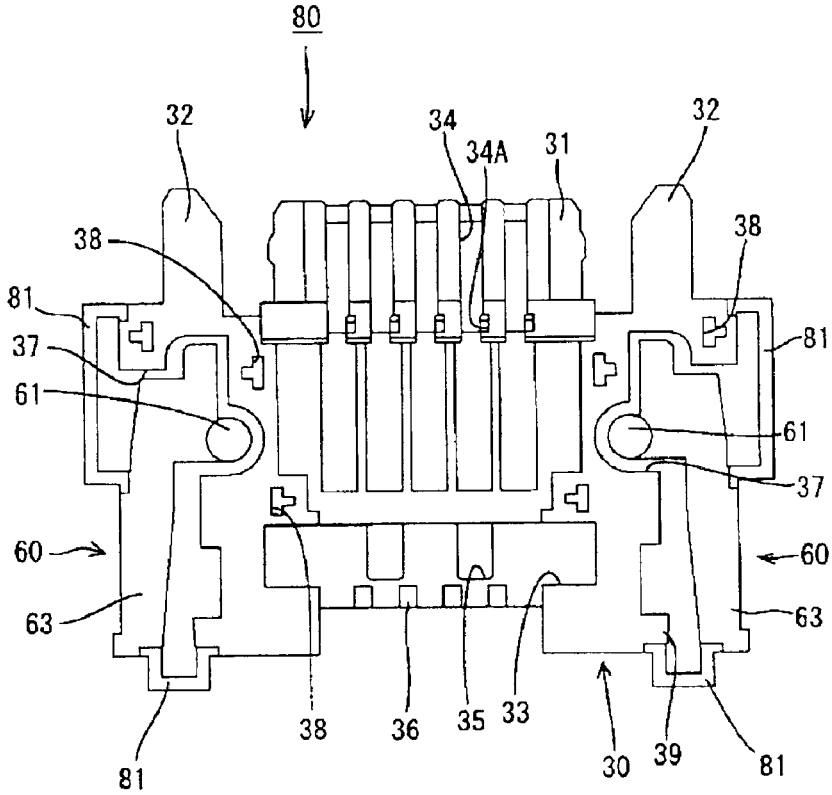
FIG. 4 is a plan view of an intermediate molded article.
Figure 5:
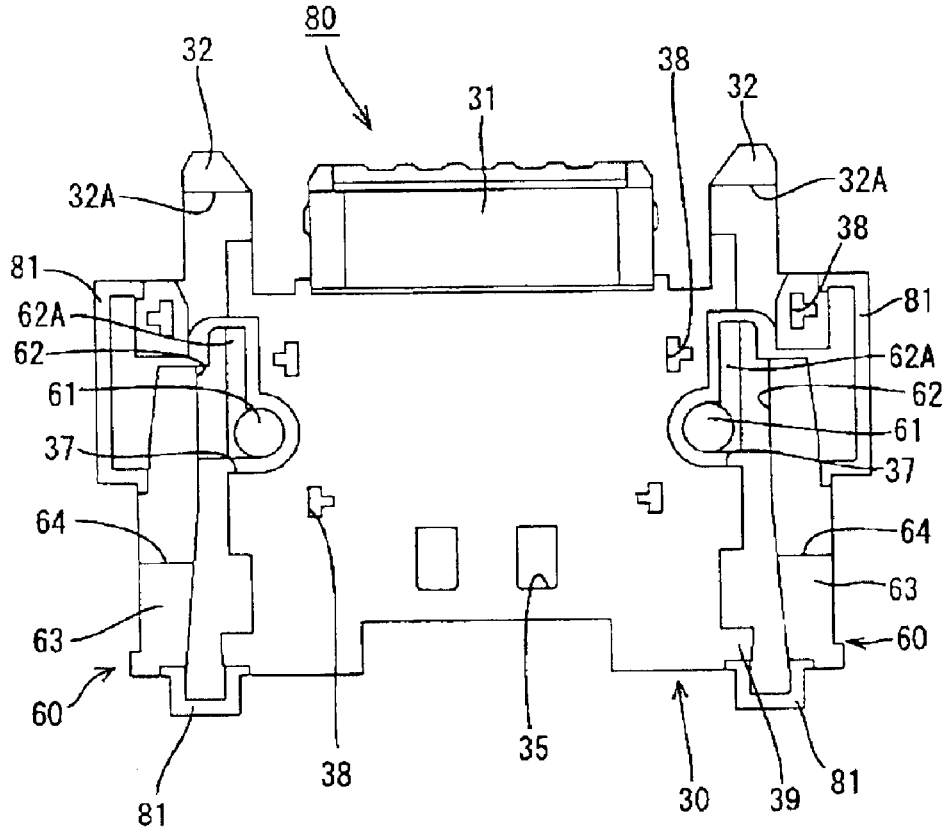
FIG. 5 is a bottom view of the intermediate molded article.

The cable-side housing 30 is made e.g. of a synthetic resin and is substantially in the form of a plate, as shown in FIGS. 4 and 5. A fittable projection 31 projects substantially in the middle at the front end of the cable-side housing 30, and protecting projections 32 project at the left and right sides of the fittable projection 31. A cable mounting recess 33 is formed in a widthwise middle of the upper surface of the cable-side housing 30, and terminal mounting grooves 34 are formed substantially side-by-side along a widthwise direction WD in an area of the upper surface of the cable-side housing 30 from the fittable projection 31 to a portion before the cable mounting recess 33. The terminal mounting grooves 31 are dimensioned to receive the cable-side terminal fittings 21. A press-in hole 34A is formed at the right side of a substantially middle part of each terminal mounting groove 34 with respect to forward and backward directions, and the press-in portion 23 of the cable-side terminal fitting 21 is insertable into the press-in hole 34A from above. Further, left and right openings 35 are formed at the rear of the cable mounting recess 33. The alignment sheet 14 of the cable 10 can be accommodated at the front of the cable mounting recess 33 to cross the respective terminal mounting grooves 34. Similarly, the shorting plate 13 of the cable 10 can be accommodated at the rear of the cable mounting recess 33 to cross the openings 35. Partition walls 36 project at the rear of the cable mounting recess 33 for partitioning the respective shielded wires 11. Further, cut-outs 37 are formed at the left and right sides of the cable-side housing 30.

Figure 6:
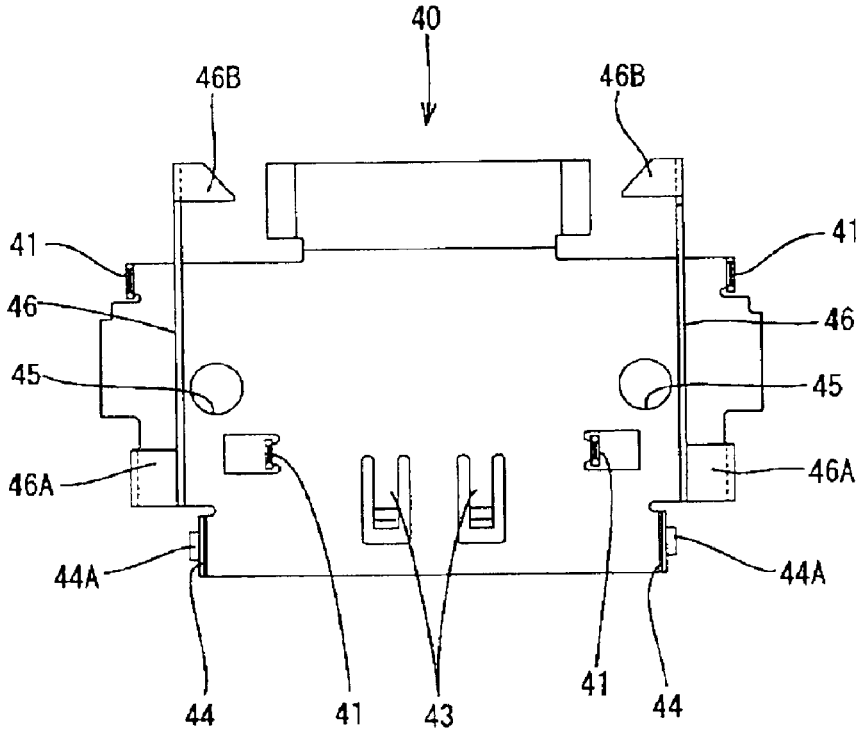
FIG. 6 is a plan view of a lower shielding plate.

The lower shielding plate 40 is formed into the shape shown in FIG. 6 by pressing, cutting, bending, embossing and/or folding the conductive metal plate and is mountable to cover most of the bottom surface of the cable-side housing 30. The lower shielding plate 40 is formed with upward-projecting press-in pieces 41 at each of the front and rear sides. The press-in pieces 41 can be pressed into insertion holes 38 formed at corresponding positions of the cable-side housing 30. Two contact pieces 43 are formed obliquely at positions on the lower shielding plate 40 near its rear end and project up through the openings 35 of the cable mounting recess 33 for contacting the lower surface of the shorting plate 13 of the cable 10. Locking plates 44 extend up from the left and right edges at the rear end of the lower shielding plate 40, and locking pieces 44A project obliquely up or in at the outer surfaces of the locking plates 44. Further, substantially round bearing holes 45 are formed at the left and right sides of the lower shielding plate 40.

Figure 7:
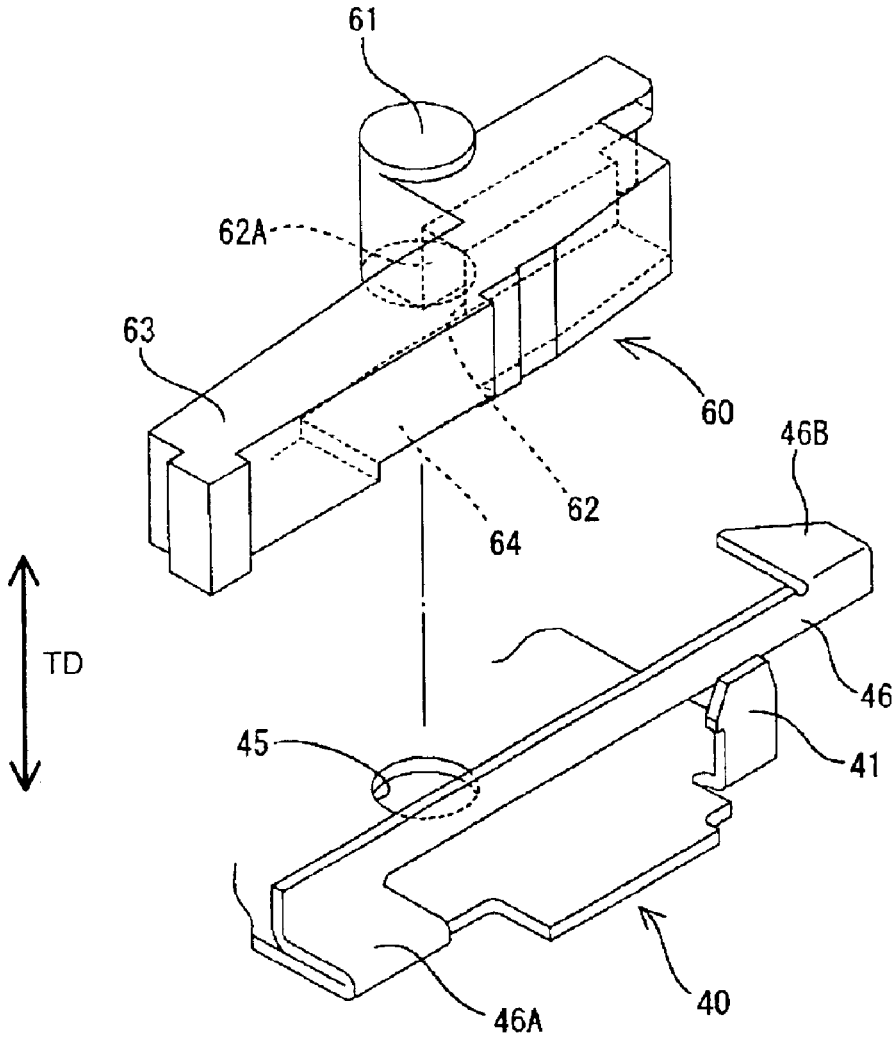
FIG. 7 is a perspective view of a lever and a resilient locking piece.

Bases 46A are formed near the rear end of the lower shielding plate 40 by folding plate pieces that extend sideways from the left and right edges so that upper parts are placed on upper surfaces of lower parts. Resilient locking pieces 46 are cantilevered forwardly from the leading ends of the bases 46A and are bent to extend substantially vertically and normal to the connecting direction CD, as shown in FIG. 7. A leading end of each resilient locking piece 46 is deformable along the widthwise direction WD, and a locking claw 46B projects in along the widthwise direction WD from the upper end of the resilient locking piece 46. The leading end of each resilient locking piece 46 is accommodated in a recess 32A in the bottom surface of the protecting wall 32 and can undergo a resilient deformation. The leading ends of the locking claws 46B project in from the protecting projections 32 when the resilient locking pieces 46 are in the unbiased locking posture shown in FIG. 1. However, the locking claws 46B are substantially entirely in the protecting projections 32 when the resilient locking pieces 46 are deformed outward into the unlocking posture shown in FIG. 9.

The upper shielding plate 50 is formed by pressing, cutting, bending and/or embossing a conductive metal plate into the shape shown in FIG. 1, and is mountable from above to cover most of the cable-side housing 30, excluding the fittable projection 31 and the protecting projections 32. Left and right press-in pieces 51 project down toward the cable-side housing 30 near the front end of the upper shielding plate 50, and can be pressed into the insertion holes 38 of the cable-side housing 30. Two upper contact pieces 52 are formed obliquely at positions on the upper shielding plate 50 near its rear end for contacting the corresponding upper surface of the shorting plate 13 of the cable 10. Engaging plates 53 stand up at left and right edges at the rear end of the upper shielding plate 50, and locking holes are formed in the engaging plates 53 to engage the locking pieces 44A of the lower shielding plate 40. Substantially round bearing holes 54 corresponding to the bearing holes 45 of the lower shielding plate 40 are formed at the left and right sides of the upper shielding plate 50.

The left and right levers 60 are formed e.g. of a synthetic resin into long narrow plates that are substantially symmetrical with each other. The levers 60 are assembled at the left and right sides of the cable-side housing 30 and are held between the upper and lower shielding plates 40, 50, as shown in FIG. 1. Substantially cylindrical shafts 61 project at opposite sides of each lever 60 with respect to the thickness direction TD, as shown in FIG. 7. The shafts 61 fit in the corresponding bearing holes 45, 54 of the upper and lower shielding plates 50, 40 to support the lever 60 rotatably about the shaft 61. A groove 62 extends forward and back substantially along the connecting direction CD in the bottom surface of a portion that bulges out from the shaft 61 along the widthwise direction WD, and an intermediate portion of the resilient locking piece 46 between the base 46A and the locking claw 46B fits in the groove 62. An operable portion 63 of the lever 60 bulges out between the upper and lower shielding plates 50, 40 and beyond the portion of the lever 60 with the groove 62. An escaping portion 64 is recessed slightly at the bottom surface of a front part of the operable portion 63, and receives the base 46A of the resilient locking piece 46. The operable portion 63 can be pushed in along the widthwise direction WD to rotate the levers 60 from the locking posture (FIG. 1) where the resilient locking pieces 46 are not deformed. Thus, inner walls 62A at the front ends of the grooves 62 push the resilient locking pieces 46 out along the widthwise direction WD and resiliently deform the locking pieces 46 (see FIG. 9). In this way, the leading ends of the locking claws 46B reach the unlocking posture and recede into the protecting projections 32. Stoppers 39 at the left and right ends of the rear part of the cable-side housing 30 achieve surface contact with the operable portions 63 and limit rotation of the levers 60. Thus, deformation of the resilient locking pieces 46 beyond the unlocking posture is prevented.

The receptacle 70 has a hood-shaped board-side housing 71 that opens forward toward the shielded connector 20, as shown in FIG. 1. The fittable projection 31 of the cable-side housing 30 can fit into the board-side housing 71. Mount grooves (not shown) are formed substantially side-by-side along the widthwise direction WD in the rear surface of the board-side housing 71, and board-side terminal fittings 72 are mounted in the respective mount grooves. One end of each board-side terminal fitting 72 is drawn out of the board-side housing 71 and connected with a conductive path on the circuit board by soldering, welding, ultrasonic welding, press-fitting, etc. The other end of the board-side terminal fitting 72 is placed in the board-side housing 71 as a resilient contact (not shown) and can contact the upper surface of the terminal connecting portion 22 of the cable-side terminal fitting 21. One mount groove (not shown) is formed at each of the left and right sides of the board-side housing 71, and ground terminals 73 are mounted in the mount grooves. One end of each ground terminal 73 connects with a ground circuit on the circuit board by soldering, welding, ultrasonic welding, press-fitting, etc. The other end of the ground terminal 73 is placed in the board-side housing 71 and can resiliently contact the corresponding lower surface of the lower shielding plate 40 inserted into the board-side housing 71. Receiving portions 74 are formed by recessing the corresponding left and right surfaces of the board-side housing 71 and engage the locking claws 46B of the resilient locking pieces 46.

The cable-side housing 30 and the levers 60 are made of synthetic resin and are molded unitarily in one die to define an intermediate molded article 80, in which the cable-side housing 30 and the levers 60 are coupled via runners 81, as shown in FIGS. 4 and 5. Runners 81 are provided for each lever 60. The cable-side housing 30 and the levers 60 are held substantially in a positional relationship of the completely assembled state. The runners 81 are formed on the outer surface of the intermediate molded article 80. Thus, the runners 81 are exposed to the outside in the assembled state to facilitate removal.

The cable-side terminal fittings 21 are mounted into the respective terminal mounting grooves 34 of the cable-side housing 30 from above after the intermediate molded article 80 is molded.

The intermediate molded article 80 is placed on the lower shielding plate 40 from above, as shown in FIG. 3, and the respective press-in pieces 41 are pressed into the corresponding insertion holes 38. Simultaneously, the shafts 61 of the levers 60 are fit into the bearing holes 45 of the lower shielding plate 40, and the resilient locking pieces 46 enter the cut-outs 37 of the fittable projection 31 and the grooves 62 of the levers 60.

Figure 8:
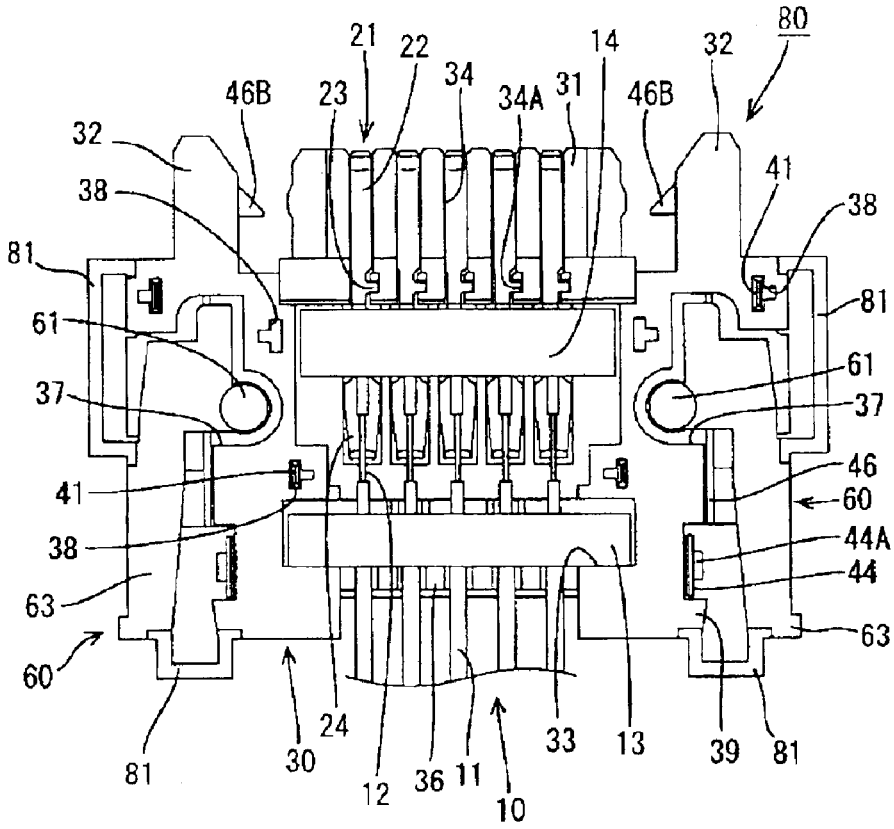
FIG. 8 is a plan view showing the cable is mounted in the housing.

The end of the cable 10 then is mounted into the cable mounting recess 33 of the cable-side housing 30 from above, and the cores 12 of the respective shielded wires 11 are pressed into the insulation-displacement grooves 25 of the corresponding cable-side terminal fittings 21, as shown in FIG. 8. In this way, shielded wires 11 are connected to the respective cable-side terminal fittings 21.

The upper shielding plate 50 then is mounted from above on the intermediate molded article 80, as shown in FIGS. 1 and 2,. Thus, the press-in pieces 51 are pressed into the corresponding insertion holes 38. In this way, the locking pieces 44A of the lower shielding plate 40 engage the corresponding engaging plates 53 of the upper shielding plate 50 to connect the upper and lower shielding plates 50, 40 electrically. Simultaneously, the shafts 61 of the levers 60 are fit into the bearing holes 54 of the upper shielding plate 50. Here, the upper shielding plate 50 is assembled using a press or the like. As the upper shielding plate 50 is assembled, the respective runners 81 are cut off from the cable-side housing 30 and the levers 60 by the press. As a result, the levers 60 are rendered rotatable about the shafts 61 and the plug 20 is substantially completed.

The plug 20 is connected with the receptacle 70 by fitting the fittable projection 31 into the board-side housing 71 in the connecting direction CD indicated by an arrow in FIG. 1. Lateral edges of the board-side housing 71 then contact the locking claws 46B of the resilient locking pieces 46 to deform the resilient locking pieces 46 out along the widthwise direction WD (see FIG. 9) and into the unlocking posture. The resilient locking pieces 46 are restored toward their locking postures and the locking claws 46B engage the receiving portions 74 of the board-side housing 71 when the plug 20 and the receptacle 70 are connected properly. Thus, the housings 30, 71 are locked in their connected state. In this way, the cores 12 of the respective shielded wires 11 of the cable 10 are connected with conductive paths on the circuit board via the cable-side terminal fittings 21 and the board-side terminal fittings 72. Further, the shielding layers of the respective shielded wires 11 are connected with the ground circuits on the circuit board via the upper and lower shielding plates 50, 40 and the ground terminals 73 to obtain shielding effects such as removal of radiation noise by the upper and lower shielding plates 50, 40.

Figure 9:
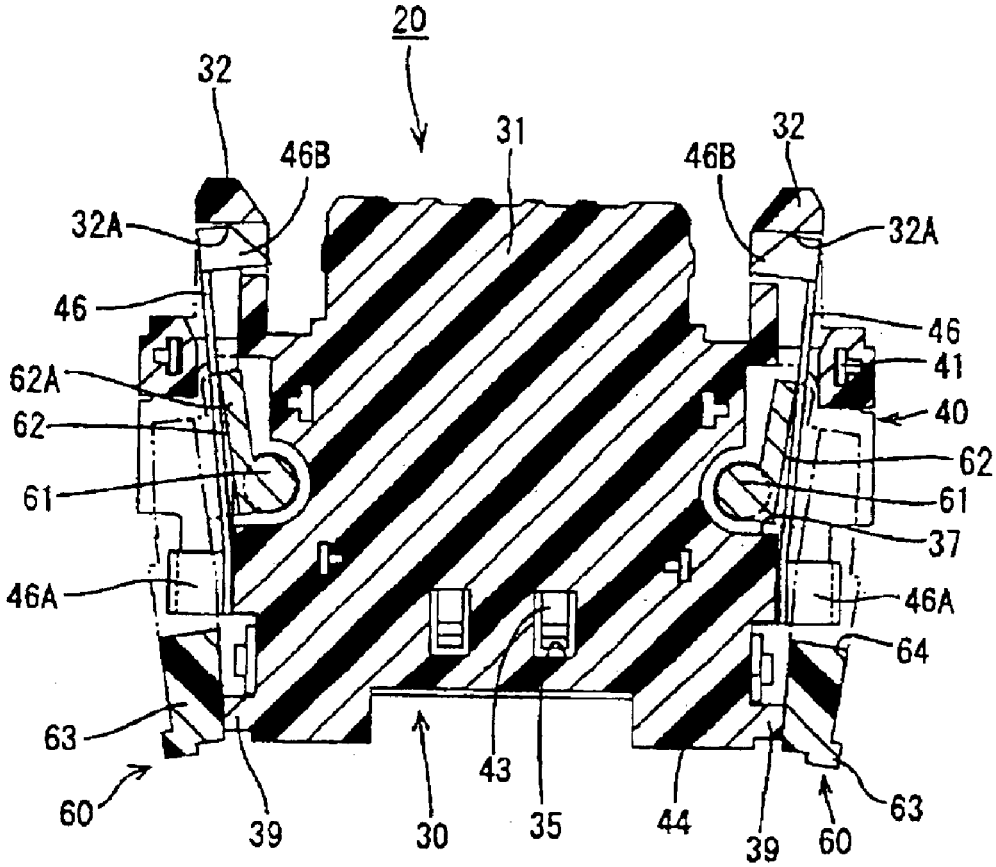
FIG. 9 is a plan view showing an unlocking operation.
Figure 10:
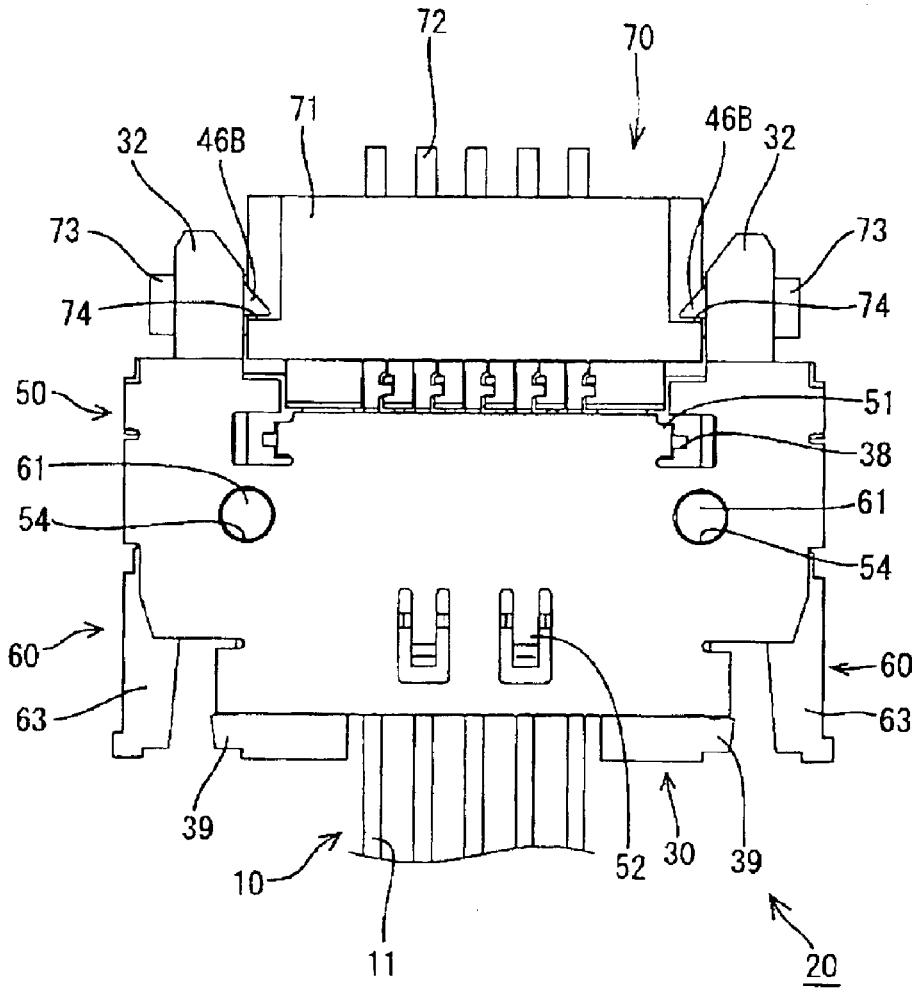
FIG. 10 is a plan view showing a state where the plug and the receptacle are connected.
Figure 11:
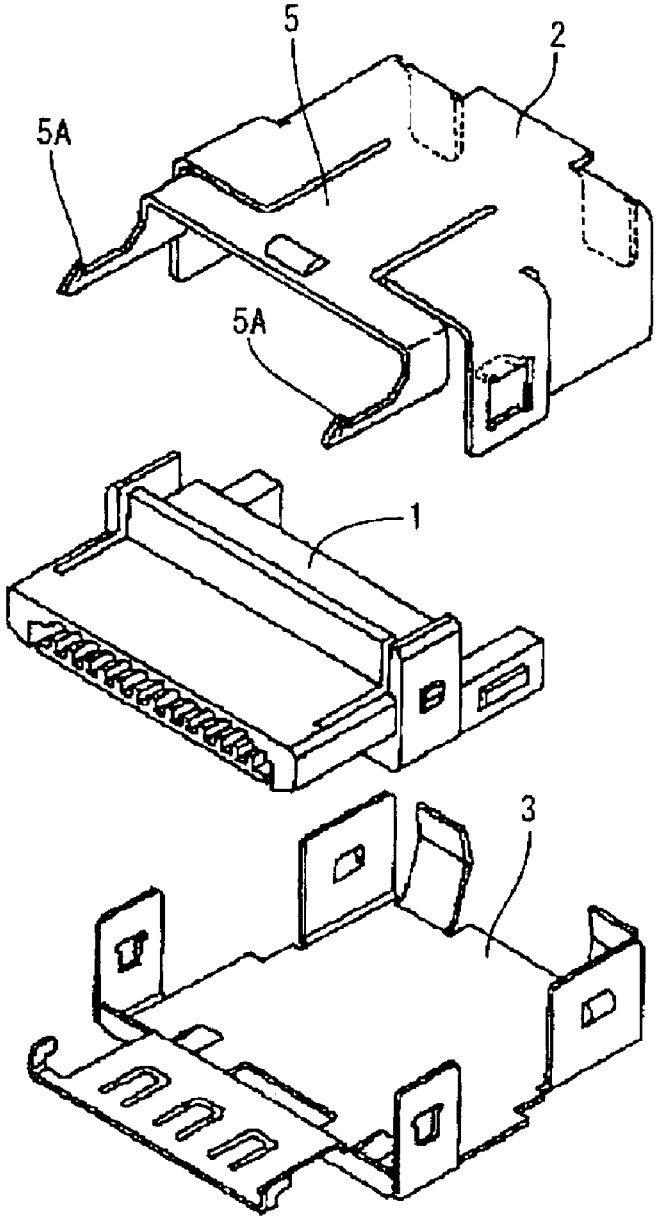
FIG. 11 PRIOR ART
FIG. 11 is an exploded perspective view showing a part of a prior art shielded connector.
Figure 12:
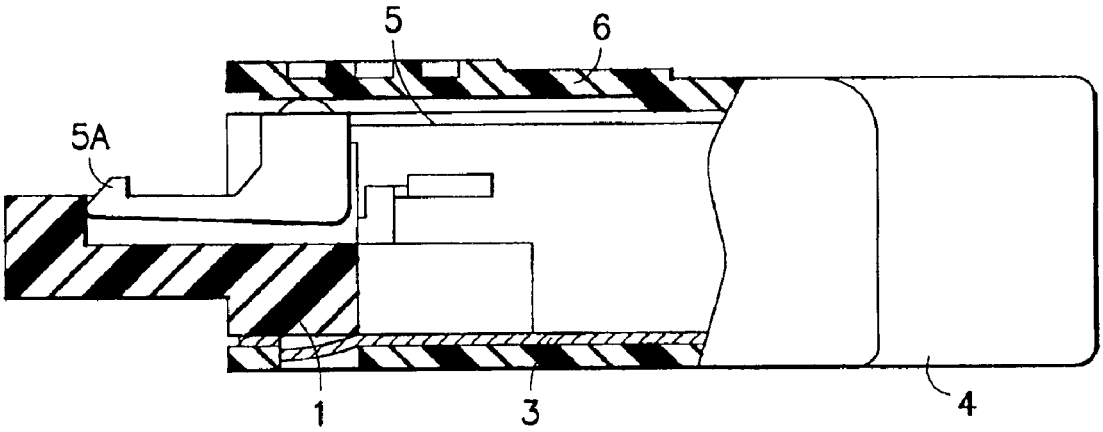
FIG. 12 PRIOR ART
FIG. 12 is a side view partly in section of the prior art connector.

The plug 20 can be detached from the receptacle 70 by pressing the operable portions 63 of the left and right levers 60 in substantially along the widthwise direction WD to rotate the levers 60 about the shafts 61. Then, as shown in FIG. 9, the inner walls 62A of the grooves 62 press the resilient locking pieces 46 and resiliently deform the locking pieces 46 outward substantially along widthwise direction WD. Thus, the locking claws 46B recede into the protecting projections 32 to disengage from the receiving portions 74. This unlocking operation can be performed easily, taking advantage of a leverage action having the shafts 61 as a fulcrum, the leading ends of the operable portions 63 as a point of force and the front ends of the inner walls 62A of the grooves 62 as a point of action. The plug 20 can be withdrawn from the receptacle 40 in this state after the resilient locking pieces 46 are brought to their unlocking postures.

As described above, the levers 60 deform the resilient locking pieces 46 into their unlocking postures. Additionally, the levers 60 are supported rotatably by the shielding plates 40, 50. Thus, it is not necessary to deform the resin during an unlocking operation and a high durability can be ensured.

Operability is good since the leverage action having the shafts 61 of the levers 60 as a fulcrum is taken advantage of upon the unlocking operation.

Furthermore, the stoppers 39 on the cable-side housing 30 can prevent the resilient locking pieces 46 from being excessively resiliently deformed.

As described above, the intermediate molded product 80 has the cable-side housing 30 and the levers 60 coupled substantially in a positional relationship attained after the assembling is completed and is assembled with the upper and lower shielding plates 40, 50 at once. Thus, the number of operation steps can be reduced to reduce the production costs.

The runners 81 are at positions to be exposed at the outer periphery of the plug 20 when the assembling is completed, and hence can be removed easily.

The invention is not limited to the above described and illustrated embodiment. For example, the following embodiment also is embraced by the invention. Beside the following embodiment, various changes can be made without departing from the scope and spirit of the present invention.

The shapes and numbers of the unlocking members and the resilient locking pieces can be changed. For example, the resilient locking pieces may be separate from the shielding shell.

The invention has been described with reference to upper and lower shielding plates as a shielding shell. However, one single or three or more shielding plates or several pairs of shielding plates may be provided as a shielding shell according to the invention.

The invention has been described with reference to a shielded connector to be connected with a mating connector mounted to a printed circuit board. However, the invention is not limited to this and may be applied to a shielded connector to be connected with or to a mating connector provided at an end of another shielded cable.

The invention is not limited to the connector producing method as described in the foregoing embodiment and may be applied to methods for producing a resin part assembly such as a lamp socket or a switch. Further, the number of resin parts unitarily molded into an intermediate molded product is not limited to three, and may be two, four or more.

The metallic shielding plates are provided as the "other part" according to the present invention in the foregoing embodiment, the other parts may, for example, be a part made of a synthetic resin according to the present invention.

The runners are cut, substantially simultaneously with the assembling of the upper shielding plate in the foregoing embodiment. However, the coupling portions may preferably be cut in an operation step after the intermediate molded product and the other part are assembled.

What is claimed is:

1. A connector comprising:

a housing into which at least one terminal fitting can be mounted and connectable with a mating connector;

a metallic shield mounted to at least partly cover surfaces of the housing, at least one resilient locking piece formed unitarily with at least a portion of the metallic shield, the resilient locking piece being resiliently deformable between a locking posture where the resilient locking piece engages the mating connector to lock the connector and the mating connector together and an unlocking posture where a locked state is canceled; and at least one movable member formed from a resin material and being rotatably supported by the metallic shield, the movable member being disposed and configured to deform the resilient locking piece from the locking posture to the unlocking posture as the movable member is rotated wherein the movable member has a rotatable shaft unitary with remaining portions of the movable member, wherein the movable member deforms the resilient locking piece by a leverage action using the rotatable shaft thereof as a fulcrum during rotation, the rotatable shaft being engaged in a bearing hole of the metallic shield at a location spaced from the resilient locking piece of the metallic shield.

2. The connector of claim 1, wherein the housing comprises at least one stopper for preventing the resilient locking piece from being excessively deformed beyond the unlocking posture by contacting the movable member when the movable member is operated to deform the resilient locking piece into the unlocking posture.

3. The connector of claim 1, wherein the housing comprises at least one projection having a cut-out into which the resilient locking piece can escape when being positioned in the unlocking posture.

4. The connector of claim 1, wherein the movable member comprises at least one escaping portion into which the resilient locking piece escapes when being moved between the locking posture and the unlocking posture.

5. The connector of claim 1, wherein the housing has opposite front and rear ends, the resilient locking piece having a base end and being cantilevered forwardly from the base end to a front end, a locking claw being defined at the front end of the resilient locking piece, the movable member having a wall disposed between the fulcrum and the locking claw and being disposed on a side of the resilient locking piece for urging the resilient locking piece into the unlocking posture, the movable member further having an operable portion rearward of the fulcrum and rearward of the resilient locking piece, whereby forces on the operable portion of the movable member pivot the movable member about the fulcrum and deflect the resilient locking piece into the unlocking posture.

6. The connector of claim 5, wherein the at least one resilient locking piece comprises first and second resilient locking pieces disposed substantially symmetrically on opposite sides of the metallic shield, the at least one movable member comprising first and second movable members on opposite sides of the housing and oriented so that movement of the operable portions of the movable members towards one another deflects the locking claws of the resilient locking pieces away from one another and into the unlocking posture.

7. The connector of claim 1, wherein the housing has a front end connectable with the mating connector and an opposite rear end, the resilient locking piece being cantilevered forwardly on the metallic shield from a base end to a front end, the front end of the resilient locking piece defining a locking claw with a rear face configured for engaging the mating connector and a front face slanted to generate deflection of the resilient locking piece relative to the housing and the movable member as the housing is connected with the mating connector.

8. The connector of claim 7, wherein the at least one resilient locking piece comprises first and second resilient locking pieces disposed substantially symmetrically on opposite sides of the metallic shield and the at least one movable member comprises first and second movable members.

* * * * *